US005508102A

United States Patent [19]

Georger et al.

[11] Patent Number: 5,508,102

[45] Date of Patent: Apr. 16, 1996

[54] ABRASION RESISTANT FIBROUS NONWOVEN COMPOSITE STRUCTURE

[75] Inventors: William A. Georger, Dunwoody, Ga.; Mark F. Jones, Huntersville, N.C.; Thomas J. Kopacz, Omro, Wis.; Gregory A. Zelazoski, Woodstock, Ga.

[73] Assignee: Kimberly-Clark Corporation, Neenah, Wis.

[21] Appl. No.: 262,163

[22] Filed: Jun. 20, 1994

Related U.S. Application Data

[62] Division of Ser. No. 956,523, Oct. 5, 1992, Pat. No. 5,350, 624.

[51] Int. Cl.[6] ..... B32B 5/08

[52] U.S. Cl. ..... 428/297; 428/298; 428/299; 264/121

[58] Field of Search ..... 428/172, 156, 428/283, 284, 786, 297, 298, 299, 300, 326, 913; 264/109, 510, 518, 113, 114

[56] References Cited

U.S. PATENT DOCUMENTS

| | | | |
|---|---|---|---|
| 3,073,735 | 1/1963 | Till et al. | 156/38 |
| 3,379,811 | 2/1965 | Hartmann et al. | 264/210 |
| 3,676,242 | 7/1972 | Prentice | 156/62.4 |
| 3,755,527 | 8/1973 | Keller et al. | 264/210 |
| 3,825,379 | 7/1974 | Lohkamp et al. | 425/72 |
| 3,825,380 | 7/1974 | Harding et al. | 425/72 |
| 3,837,995 | 9/1974 | Floden | 161/150 |
| 3,942,723 | 3/1976 | Langdon | 239/135 |
| 3,954,361 | 5/1976 | Page | 425/72 |
| 3,970,417 | 7/1976 | Page | 425/72 |
| 3,971,373 | 7/1976 | Braun | 128/146.2 |
| 3,985,481 | 10/1976 | Brackmann et al. | 425/72 |
| 4,043,739 | 8/1977 | Appel | 425/461 |
| 4,047,861 | 9/1977 | Balaz | 425/7 |
| 4,073,850 | 2/1978 | Brackmann et al. | 264/93 |
| 4,100,324 | 7/1978 | Anderson et al. | 428/288 |
| 4,118,531 | 10/1978 | Hauser | 428/224 |
| 4,287,251 | 9/1981 | King et al. | 428/198 |
| 4,295,809 | 10/1981 | Mikami et al. | 425/72 |
| 4,338,366 | 7/1982 | Evans et al. | 428/76 |
| 4,355,066 | 10/1982 | Newman | 428/198 |
| 4,429,001 | 1/1984 | Kolpin et al. | 428/283 |
| 4,486,161 | 12/1984 | Middleton | 425/7 |
| 4,526,733 | 7/1985 | Lau | 264/12 |
| 4,604,313 | 8/1986 | McFarland et al. | 428/172 |
| 4,650,479 | 3/1987 | Insley | 604/358 |
| 4,655,757 | 4/1987 | McFarland et al. | 604/366 |
| 4,720,252 | 1/1988 | Appel et al. | 425/80.1 |
| 4,724,114 | 2/1988 | McFarland et al. | 264/510 |
| 4,773,903 | 9/1988 | Weisman et al. | 604/368 |
| 4,784,892 | 11/1988 | Storey et al. | 428/172 |
| 4,818,464 | 4/1989 | Lau | 264/510 |
| 4,826,415 | 5/1989 | Mende | 425/722 |
| 4,889,476 | 12/1989 | Buehning | 425/72.2 |
| 4,927,582 | 5/1990 | Bryson | 364/113 |
| 4,986,743 | 1/1991 | Buehning | 425/7 |
| 5,017,112 | 5/1991 | Mende et al. | 425/72.2 |

OTHER PUBLICATIONS

U.S. patent application No. 07/945,442, "Process and Apparatus for Forming Nonwovens Within a Forming Chamber", Filed Sep. 14, 1992; continuation of Ser. No. 07/564,016 filed Aug. 7, 1990.

*Primary Examiner*—Patrick J. Ryan
*Assistant Examiner*—Richard P. Weisberger
*Attorney, Agent, or Firm*—Patrick C. Wilson

[57] ABSTRACT

Disclosed is an abrasion resistant fibrous nonwoven structure composed of (1) a matrix of meltblown fibers having a first exterior surface, a second exterior surface, and an interior portion; and (2) at least one other fibrous material integrated into the meltblown fiber matrix so that the concentration of meltblown fibers adjacent each exterior surface of the nonwoven structure is at least about 60 percent, by weight, and the concentration of meltblown fibers in the interior portion is less than about 40 percent, by weight. This fibrous nonwoven structure provides useful strength and low-lint characteristics as well as an abrasion resistance that is at least about 25 percent greater than that of homogenous mixture of the same components. The fibrous nonwoven structure of the present invention may be used as a moist wipe.

18 Claims, 9 Drawing Sheets

ABRASION RESISTANT FIBROUS NONWOVEN COMPOSITE STRUCTURE

This application is a divisional of application Ser. No. 07/956,523 entitled "Abrasion Resistant Fibrous Nonwoven Composite Structure" and filed in the U.S. Patent and Trademark Office on Oct. 5, 1992, now U.S. Pat. No. 5,360,624.

FIELD OF THE INVENTION

The present invention relates to a fibrous nonwoven structure composed of at least two different components and a method for making a fibrous nonwoven structure.

BACKGROUND

Fibrous nonwoven materials and fibrous nonwoven composite materials are widely used as products, or as components of products because they can be manufactured inexpensively and made to have specific characteristics. One approach to making fibrous nonwoven composite materials has been to join different types of nonwoven materials in a laminate. For example, U.S. Pat. No. 3,676,242 issued Jul. 11, 1972 to Prentice describes a laminar structure produced by bonding a nonwoven mat of fibers to a plastic film. U.S. Pat. No. 3,837,995 issued Sep. 24, 1974 to Floden discloses multiple ply fibrous nonwoven materials which contain one or more layers of thermoplastic polymer fibers autogeneously bonded to one or more layers of larger diameter natural fibers.

Another approach has been to mix thermoplastic polymer fibers with one or more other types of fibrous material and/or particulates. The mixture is collected in the form of a fibrous nonwoven composite web and may be bonded or treated to provide a coherent nonwoven composite material that takes advantage of at least some of the properties of each component. For example, U.S. Pat. No. 4,100,324 issued Jul. 11, 1978 to Anderson et al. discloses a nonwoven fabric which is a generally uniform admixture of wood pulp and meltblown thermoplastic polymer fibers. U.S. Pat. No. 3,971,373 issued Jul. 27, 1976 to Braun discloses a nonwoven material which contains meltblown thermoplastic polymer fibers and discrete solid particles. According to that patent, the particles are uniformly dispersed and intermixed with the meltblown fibers in the nonwoven material. U.S. Pat. No. 4,429,001 issued Jan. 31, 1984 to Kolpin et al. discloses an absorbent sheet material which is a combination of meltblown thermoplastic polymer fibers and solid superabsorbent particles. The superabsorbent particles are disclosed as being uniformly dispersed and physically held within a web of the meltblown thermoplastic polymer fibers.

The integrity of laminate materials described above depends in part on the techniques used to join the layers of the laminate. One disadvantage is that some effective bonding techniques add expense to the laminate materials and complexity to the manufacturing processes.

Fibrous nonwoven composites which contain a generally uniform distribution of component materials can have disadvantages which are related to the arrangement of the components. In particular, uniform distribution of certain fibers and particulates may promote linting and/or particle shedding. Another disadvantage is that composites which contain large proportions of uniformly distributed particulates or small fibers (e.g., pulp) generally have less integrity because less strength is provided by the thermoplastic polymer fiber component. This phenomenon can be seen in poor abrasion resistance and tensile strength properties of generally homogeneous composites containing large proportions of pulp and/or particulates. This problem is particularly apparent when such a nonwoven composite is used to wipe liquids or as a moist wipe. However, since pulp and certain particulates are inexpensive and can provide useful properties, it is often highly desirable to incorporate large proportions of those materials in fibrous nonwoven composite structures.

Accordingly, there is a need for a fibrous nonwoven composite structure which is inexpensive but has good abrasion resistance, integrity and wet-strength characteristics. There is also a need for a fibrous nonwoven composite structure which has a high pulp content and is inexpensive but has good abrasion resistance, integrity and wet-strength characteristics.

DEFINITIONS

As used herein, the term "fibrous nonwoven structure" refers to a structure of individual fibers or filaments which are interlaid, but not in an identifiable repeating manner. Nonwoven structures such as, for example, fibrous nonwoven webs have been, in the past, formed by a variety of processes known to those skilled in the art including, for example, meltblowing and melt spinning processes, spunbonding processes and bonded carded web processes.

As used herein, the term "abrasion resistant fibrous nonwoven composite structure" refers to a combination of meltblown thermoplastic polymer fibers and at least one other component (e.g., fibers and/or particulates) in the form of a fibrous nonwoven structure that provides abrasion resistance which is at least about 25 percent greater than the abrasion resistance of a homogenous mixture of the same components. For example, the abrasion resistance may be at least about 30 percent greater than the abrasion resistance of a homogenous mixture of the same components. Generally speaking, this is accomplished by having a greater concentration of meltblown thermoplastic polymer fibers adjacent the exterior surfaces of the fibrous nonwoven structure than in its interior portions.

As used herein, the term "meltblown fibers" refers to fibers formed by extruding a molten thermoplastic material through a plurality of fine, usually circular, die capillaries as molten threads or filaments into a high-velocity gas (e.g. air) stream which attenuates the filaments of molten thermoplastic material to reduce their diameters, which may be to microfiber diameter. Thereafter, the meltblown fibers are carried by the high-velocity gas stream and are deposited on a collecting surface to form a web of randomly disbursed meltblown fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved Device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al.

As used herein, the term "microfibers" refers to small diameter fibers having an average diameter not greater than about 100 microns, for example, having a diameter of from about 0.5 microns to about 50 microns, more specifically microfibers may also have an average diameter of from about 4 microns to about 40 microns.

As used herein, the term "disposable" is not limited to single use or limited use articles but also refers to articles that are so inexpensive to the consumer that they can be discarded if they become soiled or otherwise unusable after only one or a few uses.

As used herein, the term "pulp" refers to pulp containing fibers from natural sources such as woody and non-woody plants. Woody plants include, for example, deciduous and coniferous trees. Non-woody plants include, for example, cotton, flax, esparto grass, milkweed, straw, jute hemp, and bagasse.

As used herein, the term "porosity" refers to the ability of a fluid, such as, for example, a gas to pass through a material. Porosity may be expressed in units of volume per unit time per unit area, for example, (cubic feet per minute) per square foot of material (e.g., ($ft^3$/minute/$ft^2$) or (cfm/$ft^2$)). The porosity was determined utilizing a Frazier Air Permeability Tester available from the Frazier Precision Instrument Company and measured in accordance with Federal Test Method 5450, Standard No. 191A, except that the sample size was 8"×8" instead of 7"×7".

As used herein, the term "mean flow pore size" refers to a measure of average pore diameter as determined by a liquid displacement techniques utilizing a Coulter Porometer and Coulter POROFIL™ test liquid available from Coulter Electronics Limited, Luton, England. The mean flow pore size is determined by wetting a test sample with a liquid having a very low surface tension (i.e., Coulter POROFIL™). Air pressure is applied to one side of the sample. Eventually, as the air pressure is increased, the capillary attraction of the fluid in the largest pores is overcome, forcing the liquid out and allowing air to pass through the sample. With further increases in the air pressure, progressively smaller and smaller holes will clear. A flow versus pressure relationship for the wet sample can be established and compared to the results for the dry sample. The mean flow pore size is measured at the point where the curve representing 50% of the dry sample flow versus pressure intersects the curve representing wet sample flow versus pressure. The diameter of the pore which opens at that particular pressure (i.e., the mean flow pore size) can be determined from the following expression:

$$\text{Pore Diameter } (\mu m) = (40\tau)/\text{pressure}$$

where $\tau$=surface tension of the fluid expressed in units of mN/M; the pressure is the applied pressure expressed in millibars (mbar); and the very low surface tension of the liquid used to wet the sample allows one to assume that the contact angle of the liquid on the sample is about zero.

As used herein, the term "superabsorbent" refers to absorbent materials capable of absorbing at least 10 grams of aqueous liquid (e.g. distilled water per gram of absorbent material while immersed in the liquid for 4 hours and holding substantially all of the absorbed liquid while under a compression force of up to about 1.5 psi.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, particulates or materials added to enhance processability of a composition.

SUMMARY OF THE INVENTION

The present invention responds to the needs described above by providing an abrasion resistant fibrous nonwoven structure composed of (1) a matrix of meltblown fibers having a first exterior surface, a second exterior surface, and an interior portion; and (2) at least one other material integrated into the meltblown fiber matrix so that the concentration of meltblown fibers adjacent each exterior surface of the nonwoven structure is at least about 60 percent, by weight, and the concentration of meltblown fibers in the interior portion is less than about 40 percent, by weight. Desirably, the meltblown fiber concentration adjacent each exterior surface may be about 70 to about 90 percent, by weight, and the meltblown fiber concentration in the interior portion may be less than about 35 percent, by weight.

According to the invention, the fibrous nonwoven structure has an abrasion resistance that is at least about 25 percent greater than the abrasion resistance of a homogenous mixture of the same components. Desirably, the fibrous nonwoven structure of the present invention has an abrasion resistance that is at least about 30 percent greater than the abrasion resistance of a homogenous mixture of the same components. For example, the fibrous nonwoven structure of the present invention has an abrasion resistance that may range from about 50 percent to about 150 percent greater than the abrasion resistance of a homogenous mixture of the same components.

The matrix of meltblown fibers is typically a matrix of meltblown polyolefin fibers although other types of polymers may be used. For example, the matrix of meltblown fibers may be a matrix of meltblown fibers of polyamide, polyester, polyurethane, polyvinyl alcohol, polycaprolactone or the like. When the meltblown fibers are polyolefin fibers, they may be formed from polyethylene, polypropylene, polybutylene, copolymers of ethylene, copolymers of propylene, copolymers of butylene and mixtures of the same.

The other material which is integrated into the matrix of meltblown fibers may be selected according to the desired function of the abrasion resistant fibrous nonwoven structure. For example, the other material may be polyester fibers, polyamide fibers, polyolefin fibers, cellulosic derived fibers (e.g. pulp), multi-component fibers, natural fibers, absorbent fibers, or blends of two or more of such fibers. Alternatively and/or additionally, particulate materials such as, for example, charcoal, clay, starches, superabsorbents and the like may be used.

In one aspect of the present invention, the fibrous nonwoven structure is adapted for use as a moist wipe which contains from about 100 to about 700 dry weight percent liquid. Desirably, the moist wipe may contain from about 200 to about 450 dry weight percent liquid.

According to the present invention, the fibrous nonwoven structure has wet-strength characteristics which makes it particularly well suited for use as a moist wipe. Desirably, the fibrous nonwoven structure has a wet peel strength of at least about 0.15 pounds and a wet trapezoidal tear strength of at least about 0.30 pounds in at least two directions. More desirably, the fibrous nonwoven structure has a wet peel strength ranging from about 0.15 to about 0.20 pounds and a wet trapezoidal tear strength ranging from about 0.30 to about 0.90 pounds in at least two direction. Generally speaking, the strength characteristics will vary according to the basis weight of the fibrous nonwoven structure.

According to the present invention, the fibrous nonwoven structure may have a basis weight ranging from about 20 to about 500 grams per square meter. Desirably, the fibrous nonwoven structure may have a basis weight ranging from about 35 to about 150 grams per square meter. Even more desirably, the fibrous nonwoven structure may have a basis weight ranging from about 40 to about 90 grams per square meter. Two or more layers of the fibrous nonwoven structure may be combined to provide multi-layer materials having desired basis weights and/or functional characteristics.

In another aspect of the present invention, there is provided an abrasion resistant, low lint, high pulp content fibrous nonwoven structure composed of (1) less than about 35 percent, total weight percent, meltblown fibers forming a matrix having a first exterior surface, a second exterior surface, and an interior portion; and (2) more than about 65 percent, total weight percent, pulp fibers integrated into the meltblown fiber matrix so that the concentration of meltblown fibers adjacent each exterior surface of the nonwoven structure is at least about 60 percent, by weight, and the concentration of meltblown fibers in the interior portion is less than about 40 percent, by weight. Desirably, the fibrous nonwoven structure will contain about 65 to about 95 percent, pulp fibers, based on the total weight of the structure and from about 5 to about 35 percent meltblown fibers, based on the total weight of the structure. It is also desirable that the concentration of meltblown fibers adjacent each exterior surface of the fibrous nonwoven structure is about 70 to about 90 percent, by weight, and the concentration of meltblown fibers in the interior portion is less than about 35 percent, by weight.

This high pulp content fibrous nonwoven structure has an abrasion resistance that is at least about 25 percent greater than the abrasion resistance of a homogenous mixture of the same components. More desirably, the fibrous nonwoven structure of the present invention has an abrasion resistance that is at least about 30 percent greater than the abrasion resistance of a homogenous mixture of the same components. For example, the fibrous nonwoven structure of the present invention has an abrasion resistance that may range from about 50 percent to about 150 percent greater than the abrasion resistance of a homogenous mixture of the same components. The high pulp content fibrous nonwoven structure also provides a lint loss of less than about 50 particles of 10 micron size per 0.01 $ft^3$ of air and less than about 200 particles of 0.5 micron size per 0.01 $ft^3$ of air as determined in accordance with dry Climet Lint test methods. For example, the lint loss may be less than about 40 particles of 10 micron size per 0.01 $ft^3$ of air and less than about 175 particles of 0.5 micron size per 0.01 $ft^3$ of air.

The abrasion resistant, high pulp content fibrous nonwoven structures may have a wide range of basis weights. For example, its basis weight may range from about 40 to about 500 gsm. Two or more layers of the high pulp content fibrous nonwoven structure may be combined to provide multi-layer materials having desired basis weights and/or functional characteristics. According to the present invention, this abrasion resistant, high pulp content fibrous nonwoven structure is particularly well suited as a moist wipe. Such a moist wipe may be produced so inexpensively that it may be economical to dispose of the wipe after a single or limited use. The abrasion resistant, high pulp content fibrous nonwoven structure may be used a moist wipe containing from about 100 to about 700 dry weight percent liquid. Desirably, such a moist wipe may contain from about 200 to about 450 dry weight percent liquid.

DETAILED DESCRIPTION OF THE INVENTION

Figure 1:
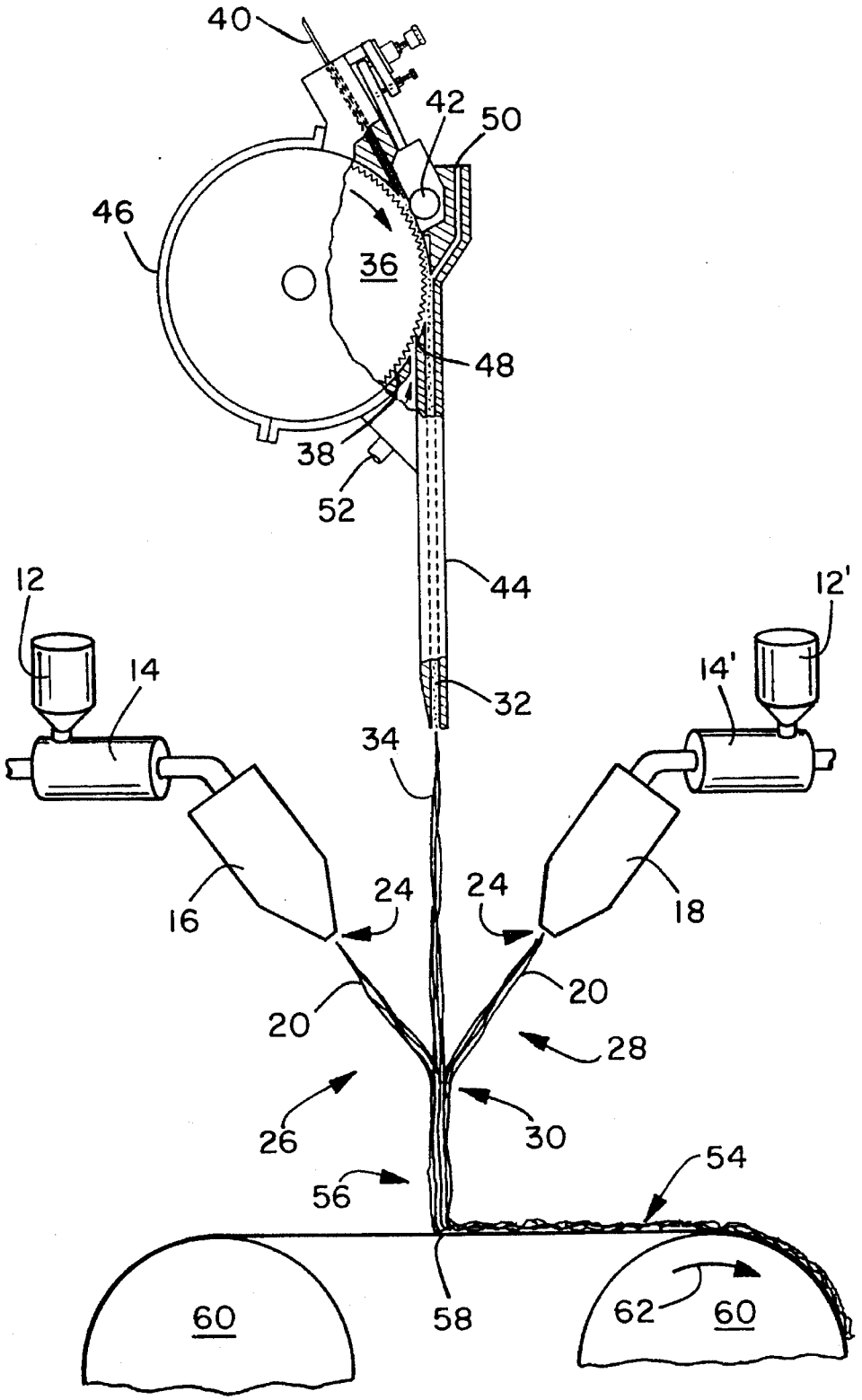
FIG. 1 is an illustration of an apparatus which may be used to form an abrasion resistant fibrous nonwoven composite structure.

Turning now to the figures wherein like reference numerals represent the same or equivalent structure and, in particular, to FIG. 1 where it can be seen that an exemplary apparatus for forming an abrasion resistant fibrous nonwoven composite structure is generally represented by reference numeral 10. In forming the abrasion resistant fibrous nonwoven composite structure of the present invention, pellets or chips, etc. (not shown) of a thermoplastic polymer are introduced into a pellet hopper 12 of an extruder 14.

The extruder 14 has an extrusion screw (not shown) which is driven by a conventional drive motor (not shown). As the polymer advances through the extruder 14, due to rotation of the extrusion screw by the drive motor, it is progressively heated to a molten state. Heating the thermoplastic polymer to the molten state may be accomplished in a plurality of discrete steps with its temperature being gradually elevated as it advances through discrete heating zones of the extruder 14 toward two meltblowing dies 16 and 18, respectively. The meltblowing dies 16 and 18 may be yet another heating zone where the temperature of the thermoplastic resin is maintained at an elevated level for extrusion.

Each meltblowing die is configured so that two streams of attenuating gas per die converge to form a single stream of gas which entrains and attenuates molten threads 20, as the threads 20 exit small holes or orifices 24 in the meltblowing die. The molten threads 20 are attenuated into fibers or, depending upon the degree of attenuation, microfibers, of a small diameter which is usually less than the diameter of the orifices 24. Thus, each meltblowing die 16 and 18 has a corresponding single stream of gas 26 and 28 containing entrained and attenuated polymer fibers. The gas streams 26 and 28 containing polymer fibers are aligned to converge at an impingement zone 30.

One or more types of secondary fibers 32 (and/or particulates) are added to the two streams 26 and 28 of thermoplastic polymer fibers or microfibers 24 at the impingement zone 30. Introduction of the secondary fibers 32 into the two streams 26 and 28 of thermoplastic polymer fibers 24 is designed to produce a graduated distribution of secondary fibers 32 within the combined streams 26 and 28 of thermoplastic polymer fibers. This may be accomplished by merging a secondary gas stream 34 containing the secondary fibers 32 between the two streams 26 and 28 of thermoplastic polymer fibers 24 so that all three gas streams converge in a controlled manner.

Apparatus for accomplishing this merger may include a conventional picker roll 36 arrangement which has a plurality of teeth 38 that are adapted to separate a mat or batt 40 of secondary fibers into the individual secondary fibers 32. The mat or batt of secondary fibers 40 which is fed to the picker roll 36 may be a sheet of pulp fibers (if a two-component mixture of thermoplastic polymer fibers and secondary pulp fibers is desired), a mat of staple fibers (if a two-component mixture of thermoplastic polymer fibers and a secondary staple fibers is desired) or both a sheet of pulp fibers and a mat of staple fibers (if a three-component mixture of thermoplastic polymer fibers, secondary staple fibers and secondary pulp fibers is desired). In embodiments where, for example, an absorbent material is desired, the secondary fibers 32 are absorbent fibers. The secondary fibers 32 may generally be selected from the group including one or more polyester fibers, polyamide fibers, cellulosic derived fibers such as, for example, rayon fibers and wood pulp fibers, multi-component fibers such as, for example, sheath-core multi-component fibers, natural fibers such as silk fibers, wool fibers or cotton fibers or electrically conductive fibers or blends of two or more of such secondary fibers. Other types of secondary fibers 32 such as, for example, polyethylene fibers and polypropylene fibers, as well as blends of two or more of other types of secondary fibers 32 may be utilized. The secondary fibers 32 may be microfibers or the secondary fibers 32 may be macrofibers having an average diameter of from about 300 microns to about 1,000 microns.

The sheets or mats 40 of secondary fibers 32 are fed to the picker roll 36 by a roller arrangement 42. After the teeth 36 of the picker roll 26 have separated the mat of secondary fibers 40 into separate secondary fibers 32 the individual secondary fibers 32 are conveyed toward the stream of thermoplastic polymer fibers or microfibers 24 through a nozzle 44. A housing 46 encloses the picker roll 36 and provides a passageway or gap 48 between the housing 46 and the surface of the teeth 38 of the picker roll 36. A gas, for example, air, is supplied to the passageway or gap 46 between the surface of the picker roll 36 and the housing 48 by way of a gas duct 50. The gas duct 50 may enter the passageway or gap 46 generally at the junction 52 of the nozzle 44 and the gap 48. The gas is supplied in sufficient quantity to serve as a medium for conveying the secondary fibers 32 through the nozzle 44. The gas supplied from the duct 50 also serves as an aid in removing the secondary fibers 32 from the teeth 38 of the picker roll 36. The gas may be supplied by any conventional arrangement such as, for example, an air blower (not shown). It is contemplated that additives and/or other materials may be add to or entrained in the gas stream to treat the secondary fibers.

Generally speaking, the individual secondary fibers 32 are conveyed through the nozzle 44 at about the velocity at which the secondary fibers 32 leave the teeth 38 of the picker roll 36. In other words, the secondary fibers 32, upon leaving the teeth 38 of the picker roll 36 and entering the nozzle 44 generally maintain their velocity in both magnitude and direction from the point where they left the teeth 38 of the picker roll 36. Such an arrangement, which is discussed in more detail in U.S. Pat. No. 4,100,324 to Anderson, et al., hereby incorporated by reference, aids in substantially reducing fiber floccing.

The width of the nozzle 44 should be aligned in a direction generally parallel to the width of the meltblowing dies 16 and 18. Desirably, the width of the nozzle 44 should be about the same as the width of the meltblowing dies 16 and 18. Usually, the width of the nozzle 44 should not exceed the width of the sheets or mats 40 that are being fed to the picker roll 36. Generally speaking, it is desirable for the length of the nozzle 44 to be as short as equipment design will allow.

The picker roll 36 may be replaced by a conventional particulate injection system to form a composite nonwoven structure 54 containing various secondary particulates. A combination of both secondary particulates and secondary fibers could be added to the thermoplastic polymer fibers prior to formation of the composite nonwoven structure 54 if a conventional particulate injection system was added to the system illustrated in FIG. 1. The particulates may be, for example, charcoal, clay, starches, and/or hydrocolloid (hydrogel) particulates commonly referred to as super-absorbents.

FIG. 1 further illustrates that the secondary gas stream 34 carrying the secondary fibers 32 is directed between the streams 26 and 28 of thermoplastic polymer fibers so that the streams contact at the impingement zone 30. The velocity of the secondary gas stream 34 is usually adjusted so that it is greater than the velocity of each stream 26 and 28 of thermoplastic polymer fibers 24 when the streams contact at the impingement zone 30. This feature is different from many conventional processes for making composite materials. Those conventional processes rely on an aspirating effect where a low-speed stream of secondary material is drawn into a high-speed stream of thermoplastic polymer fibers to enhance turbulent mixing which results in a homogenous composite material.

Instead of a homogenous composite material, the present invention is directed to a nonwoven structure in which the components can be described as having a graduated distribution. Although the inventors should not be held to a particular theory of operation, it is believed that adjusting the velocity of the secondary gas stream 34 so that it is greater than the velocity of each stream 26 and 28 of thermoplastic polymer fibers 24 when the streams intersect at the impingement zone 30 can have the effect that, during merger and integration thereof, between the impingement zone 30 and a collection surface, a graduated distribution of the fibrous components can be accomplished.

The velocity difference between the gas streams may be such that the secondary fibers 32 are integrated into the streams of thermoplastic polymer fibers 26 and 28 in such manner that the secondary fibers 32 become gradually and only partially distributed within the thermoplastic polymer fibers 24. Generally, for increased production rates the gas streams which entrain and attenuate the thermoplastic polymer fibers 24 should have a comparatively high initial velocity, for example, from about 200 feet to over 1,000 feet per second. However, the velocity of those gas streams decreases rapidly as they expand and become separated from the meltblowing die. Thus, the velocity of those gas streams at the impingement zone may be controlled by adjusting the distance between the meltblowing die and the impingement zone. The stream of gas 34 which carries the secondary fibers 32 will have a low initial velocity when compared to the gas streams 26 and 28 which carry the meltblown fibers. However, by adjusting the distance from the nozzle 44 to the impingement zone 30 (and the distances that the meltblown fiber gas streams 26 and 28 must travel), the velocity of the gas stream 34 can be controlled to be greater than the meltblown fiber gas streams 26 and 28.

Due to the fact that the thermoplastic polymer fibers 24 are usually still semi-molten and tacky at the time of incorporation of the secondary fibers 32 into the thermoplastic polymer fiber streams 26 and 28, the secondary fibers 32 are usually not only mechanically entangled within the matrix formed by the thermoplastic polymer fibers 24 but are also thermally bonded or joined to the thermoplastic polymer fibers 24.

In order to convert the composite stream 56 of thermoplastic polymer fibers 24 and secondary fibers 32 into a composite nonwoven structure 54 composed of a coherent matrix of the thermoplastic polymer fibers 24 having the secondary fibers 32 distributed therein, a collecting device is located in the path of the composite stream 56. The collecting device may be an endless belt 58 conventionally driven by rollers 60 and which is rotating as indicated by the arrow 62 in FIG. 1. Other collecting devices are well known to those of skill in the art and may be utilized in place of the endless belt 58. For example, a porous rotating drum arrangement could be utilized. The merged streams of thermoplastic polymer fibers and secondary fibers are collected as a coherent matrix of fibers on the surface of the endless belt 58 to form the composite nonwoven web 54. Vacuum boxes 64 assist in retention of the matrix on the surface of the belt 58. The vacuum may be set at about 1 to about 4 inches of water column.

The composite structure 54 is coherent and may be removed from the belt 58 as a self-supporting nonwoven material. Generally speaking, the composite structure has adequate strength and integrity to be used without any post-treatments such as pattern bonding and the like. If desired, a pair of pinch rollers or pattern bonding rollers may be used to bond portions of the material. Although such treatment may improve the integrity of the nonwoven composite structure 54 it also tends to compress and densify the structure.

Figure 2:
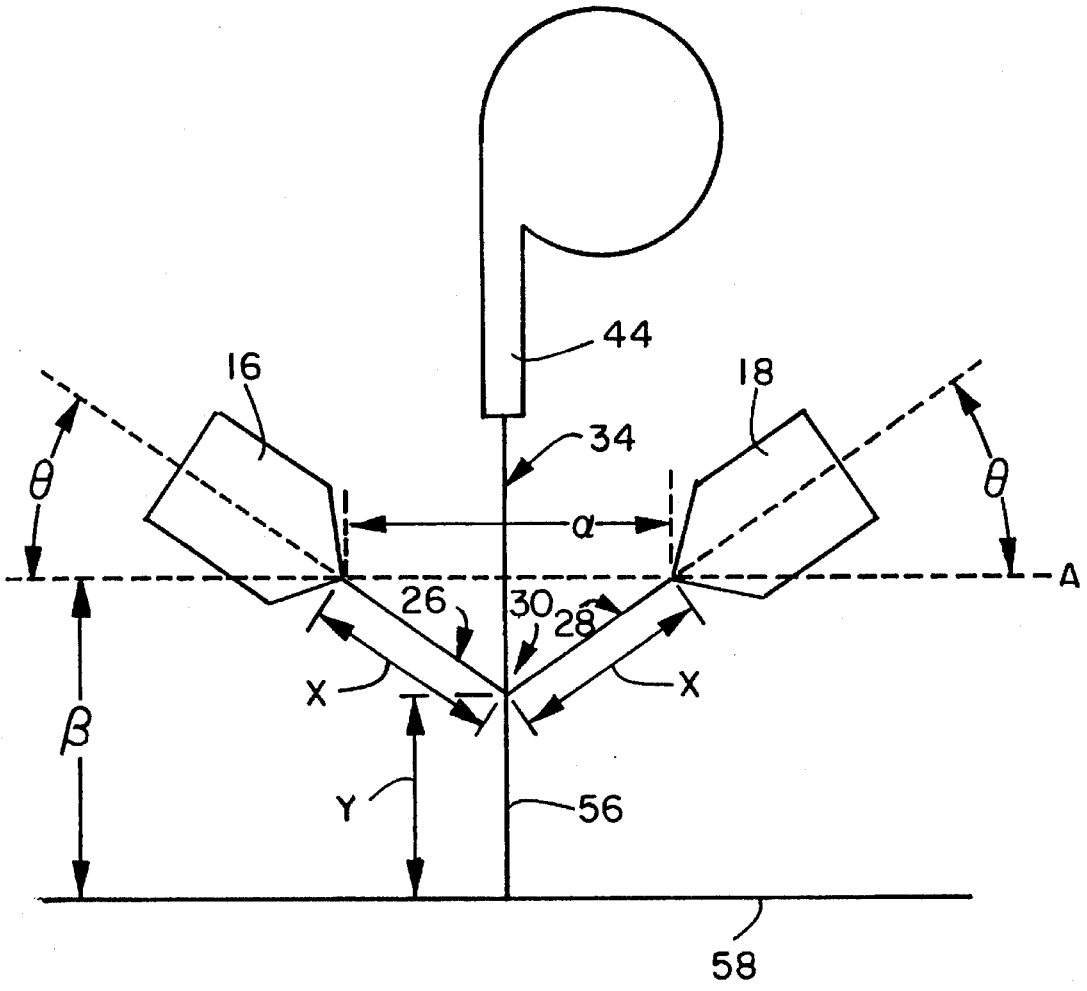
FIG. 2 is an illustration of certain features of the apparatus shown in FIG. 1.

Referring now to FIG. 2 of the drawings, there is shown a schematic diagram of an exemplary process described in FIG. 1. FIG. 2 highlights process variables which will affect the type of fibrous nonwoven composite structure made. Also shown are various forming distances which affect the type of fibrous nonwoven composite structure.

The melt-blowing die arrangements 16 and 18 are mounted so they each can be set at an angle. The angle is measured from a plane tangent to the two dies (plane A). Generally speaking, plane A is parallel to the forming surface (e.g., the endless belt 58). Typically, each die is set at an angle (Θ) and mounted so that the streams of gas-borne fibers and microfibers 26 and 28 produced from the dies intersect in a zone below plane A (i.e., the impingement zone 30). Desirably, angle Θ may range from about 30 to about 75 degrees. More desirably, angle Θ may range from about 35 to about 60 degrees. Even more desirably, angle Θ may range from about 45 to about 55 degrees.

Meltblowing die arrangements 16 and 18 are separated by a distance (α). Generally speaking, distance α may range up to about 16 inches. Distance α may be set even greater than 16 inches to produce a lofty, bulky material which is somewhat weaker and less coherent than materials produced at shorter distances. Desirably, α may range from about 5 inches to about 10 inches. More desirably, α may range from about 6.5 to about 9 inches. Importantly, the distance α between the meltblowing dies and the angle Θ of each meltblowing die determines location of the impingement zone 30.

The distance from the impingement zone 30 to the tip of each meltblowing die (i.e., distance X) should be set to minimize dispersion of each stream of fibers and microfibers 26 and 28. For example, this distance may range from about 0 to about 16 inches. Desirably, this distance should be greater than 2.5 inches. For example, from about 2.5 to 6 inches the distance from the tip of each meltblowing die arrangement can be determined from the separation between the die tips (α) and the die angle (Θ) utilizing the formula:

$$X=\alpha/(2\cos\Theta)$$

Generally speaking, the dispersion of the composite stream 56 may be minimized by selecting a proper vertical forming distance (i.e., distance β) before the stream 56 contacts the forming surface 58. β is distance from the meltblowing die tips 70 and 72 to the forming surface 58. A shorter vertical forming distance is generally desirable for minimizing dispersion. This must be balanced by the need for the extruded fibers to solidify from their tacky, semi-molten state before contacting the forming surface 58. For example, the vertical forming distance (β) may range from about 3 to about 15 inches from the meltblown die tip. The vertical forming distance (β) may be set even greater than 15 inches to produce a lofty, bulky material which is somewhat weaker and less coherent than materials produced at shorter distances. Desirably, this vertical distance (β) may be about 7 to about 11 inches from the die tip.

An important component of the vertical forming distance β is the distance between the impingement zone 30 and the forming surface 58 (i.e., distance Y). The impingement zone 30 should be located so that the integrated streams have only a minimum distance (Y) to travel to reach the forming surface 58 to minimize dispersion of the entrained fibers and microfibers. For example, the distance (Y) from the impingement zone to the forming surface may range from about 0 to about 12 inches. Desirably, the distance (Y) from the impingement point to the forming surface may range from about 3 to about 7 inches. The distance from the impingement zone 30 and the forming surface 58 can be determined from the vertical forming distance (β), the separation between the die tips (α) and the die angle (Θ) utilizing the formula:

$$Y=\beta-((\alpha/2)*\cos\Theta)$$

Gas entrained secondary fibers are introduced into the impingement zone via a stream 34 emanating from a nozzle 44. Generally speaking, the nozzle 44 is positioned so that its vertical axis is substantially perpendicular to plane A (i.e., the plane tangent to the meltblowing dies 16 and 18)

In some situations, it may be desirable to cool the secondary air stream 34. Cooling the secondary air stream could accelerate the quenching of the molten or tacky meltblown fibers and provide for shorter distances between the meltblowing die tip and the forming surface which could be used to minimize fiber dispersion and enhance the gradient distribution of the composite structure. For example, the temperature of the secondary air stream 22 may be cooled to about 15 to about 85 degrees Fahrenheit.

By balancing the streams of meltblown fibers 26 and 28 and secondary air stream 34, the desired die angles (Θ) of the meltblowing dies, the vertical forming distance (β), the distance between the meltblowing die tips (α), the distance between the impingement zone and the meltblowing die tips (X) and the distance between the impingement zone and the forming surface (Y), it is possible to provide a controlled integration of secondary fibers within the meltblown fiber streams to produce a fibrous nonwoven composite structure having a greater concentration of meltblown fibers adjacent its exterior surfaces and a lower concentration of meltblown fibers (i.e., a greater concentration of secondary fibers and/or particulates) in the inner portion of the fibrous nonwoven composite structure.

Figure 3:
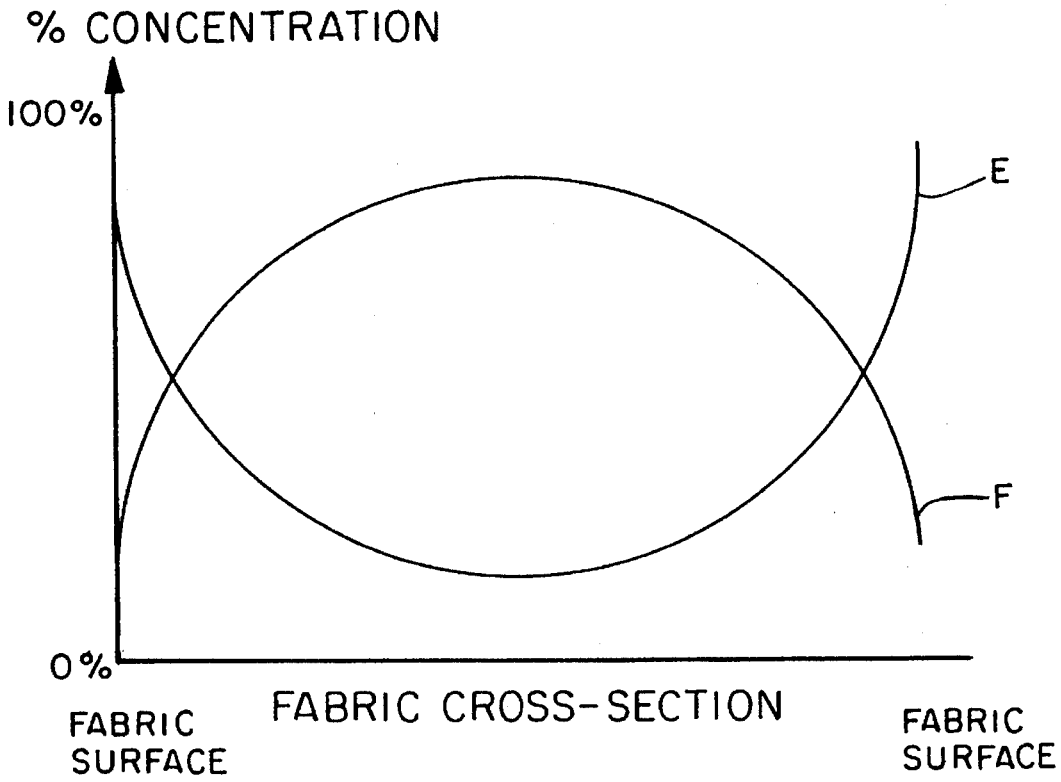
FIG. 3 is a general representation of an exemplary meltblown fiber concentration gradient for a cross section of an abrasion resistant fibrous nonwoven composite structure.

A general representation of an exemplary meltblown fiber concentration gradient for a cross section such a fibrous nonwoven composite structure is illustrated in FIG. 3. Curve E represents the meltblown polymer fiber concentration and curve F represents the pulp concentration.

Figure 4:
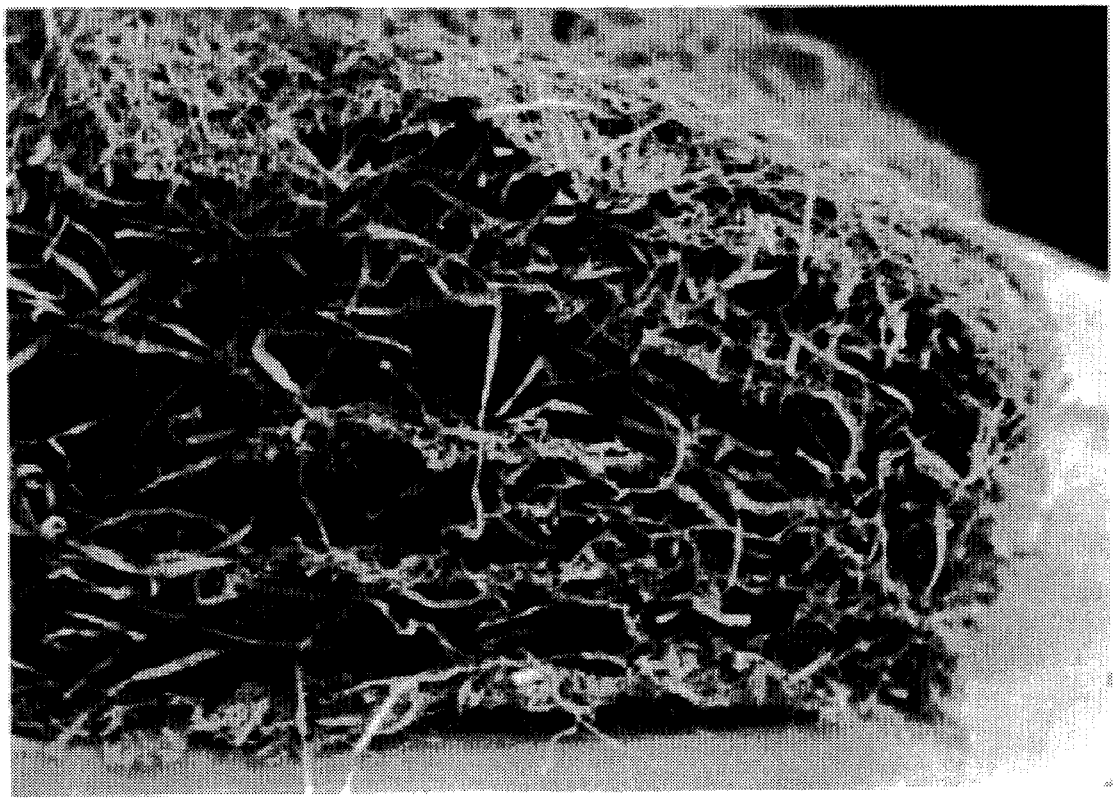
FIG. 4 is a photomicrograph of an exemplary high abrasion resistant fibrous nonwoven composite structure.
Figure 5:
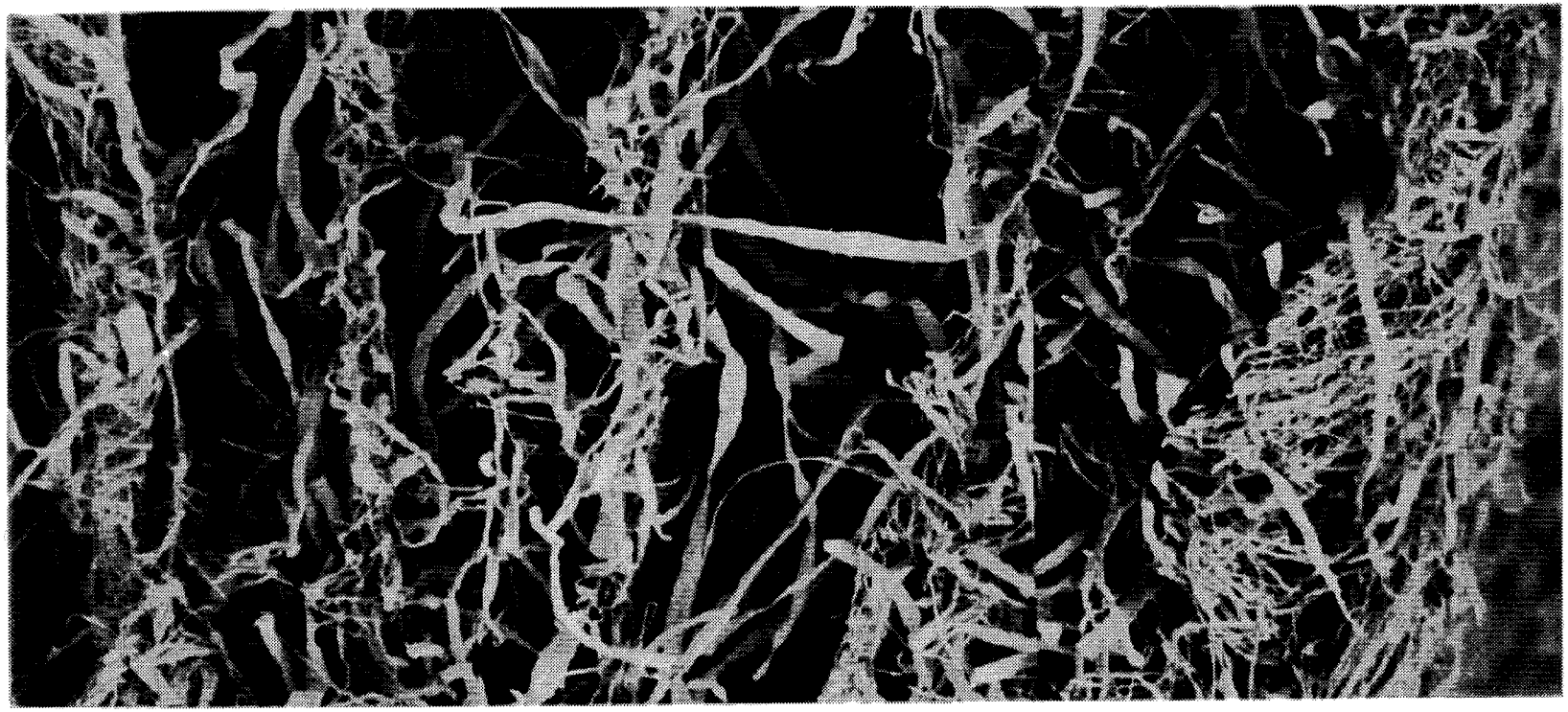
FIG. 5 is an enlarged photomicrograph of the exemplary nonwoven composite structure shown in FIG. 4.

Referring now to FIGS. 4–9, those figures are scanning electron microphotographs of various fibrous nonwoven composite structures containing about 40 percent, by weight, meltblown polypropylene fibers and about 60 percent, by weight, wood pulp. More particularly, FIG. 4 is a 20.7× (linear magnification) photomicrograph of an exemplary high abrasion resistant fibrous nonwoven composite structure. FIG. 5 is a 67.3× (linear magnification) photomicrograph of the exemplary nonwoven composite structure shown in FIG. 4. As can be seen from FIGS. 4 and 5, the concentration of meltblown fibers is greater adjacent the top and bottom surfaces (i.e., exterior surfaces) of the structure. Meltblown fibers are also distributed throughout the inner portion of the structure, but at much lower concentrations. Thus, it can be seen that the structure of FIGS. 4 and 5 can be described as a matrix of meltblown fibers in which secondary fibers have been integrated in a controlled manner so that concentration of meltblown fibers is greater adjacent the exterior surfaces of the structure and lower in the interior portion of the structure.

Although the inventors should not be held to a particular theory of operation, it is believed that the structure of FIGS. 4 and 5 represents a controlled or non-homogeneous distribution of secondary fibers meltblown fibers within the matrix of meltblown fibers as described above. While the distribution of secondary fibers within the meltblown fiber matrix does not appear to follow a precise gradient pattern, a cross-section of the structure does appear to exhibit increasing concentrations of meltblown fibers approaching its exterior surfaces and decreasing concentrations of meltblown fibers approaching its interior portions. This distribution is believed to be especially advantageous because, although the concentration of meltblown fibers in the inner portions of the structure is reduced, sufficient amounts of meltblown fibers are still present so that the nonwoven structure has many of the desirable strength and integrity characteristics of a generally homogenous structure while also providing desirable abrasion resistance properties due to the presence of high concentrations of meltblown fibers adjacent the exterior surfaces of the structure.

Figure 6:
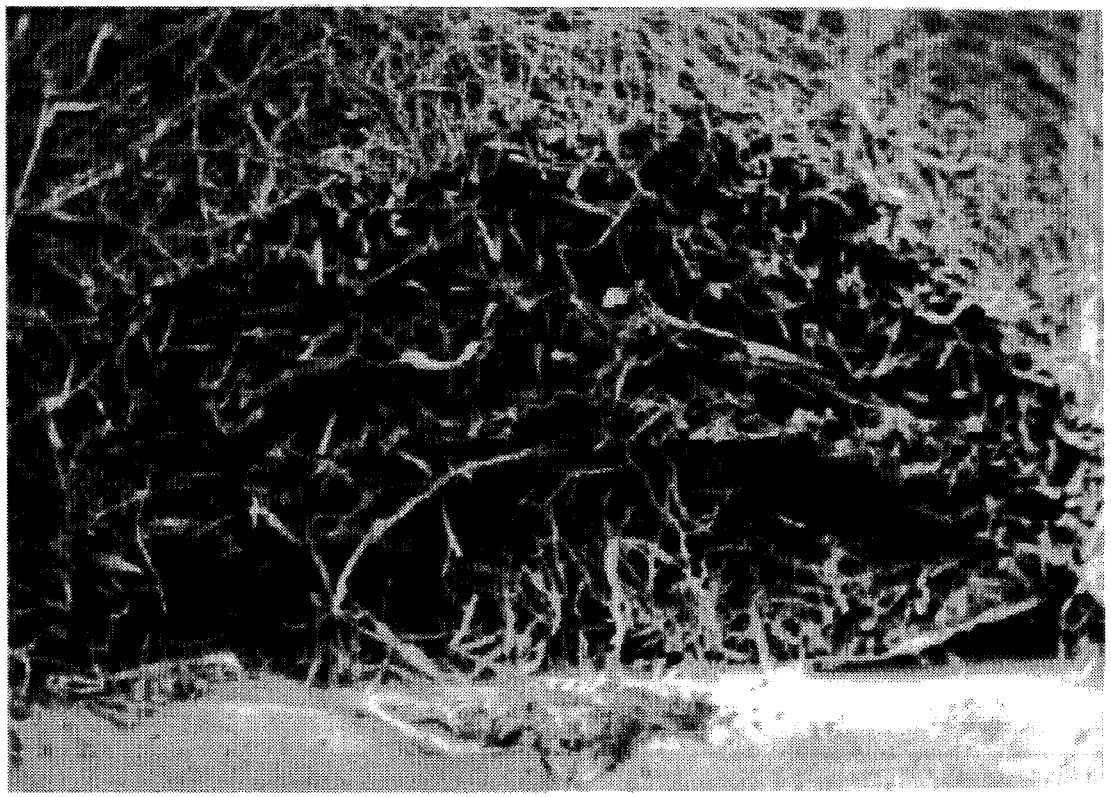
FIG. 6 is a photomicrograph of an exemplary homogenous fibrous nonwoven composite structure.
Figure 7:
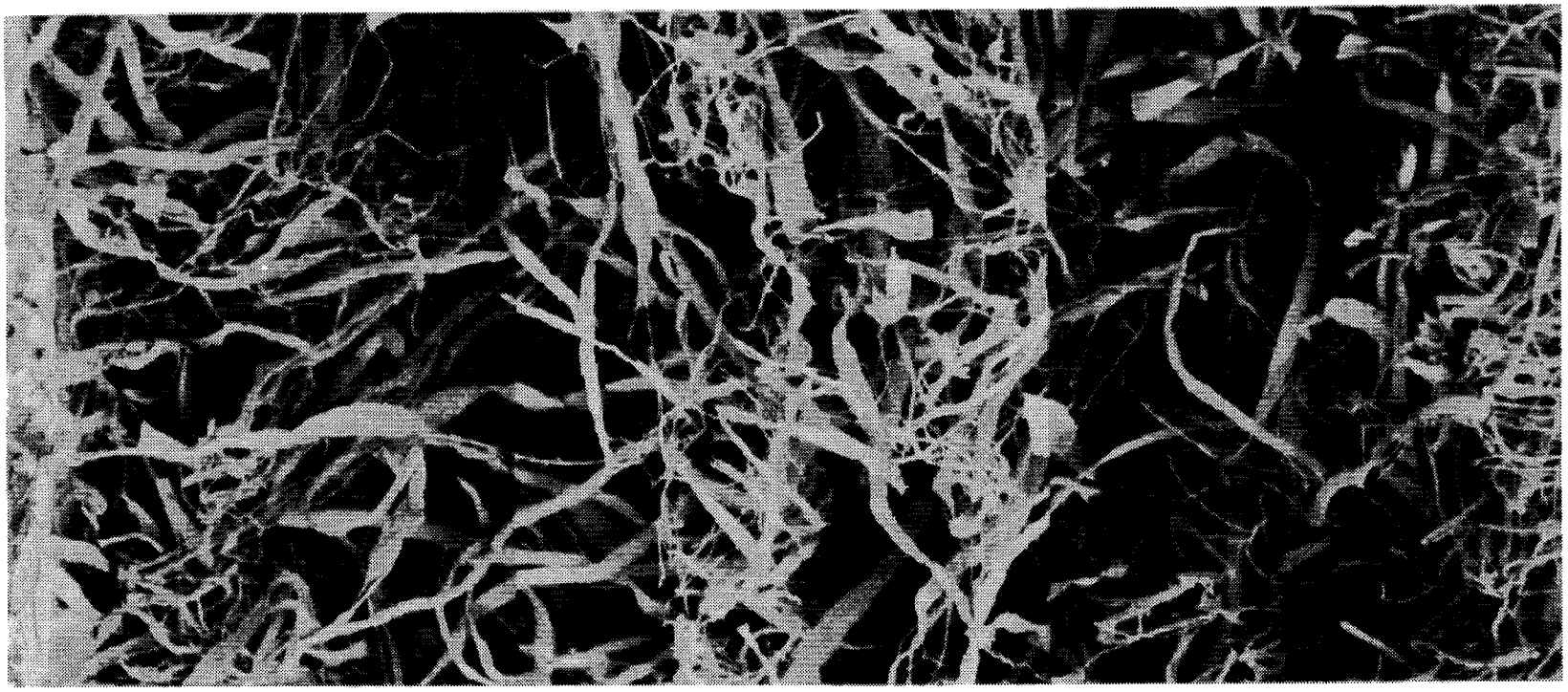
FIG. 7 is an enlarged photomicrograph of the exemplary homogenous nonwoven composite structure shown in FIG. 6.

FIG. 6 is a 20.7× (linear magnification) photomicrograph of an exemplary homogenous fibrous nonwoven composite structure. FIG. 7 is a 67.3× (linear magnification) photomicrograph of the exemplary homogenous nonwoven composite structure shown in FIG. 6. The composite structure shown in FIGS. 6 and 7 is a substantially homogenous mixture of meltblown polypropylene fibers and wood pulp. The homogenous mixture is an example of the type of material typically produced utilizing conventional techniques for making fibrous nonwoven composite webs. As is evident from FIGS. 6 and 7, meltblown fibers and wood pulp are uniformly distributed throughout all sections of the composite structure. The distribution of meltblown fibers is substantially the same adjacent the exterior surfaces of the structure as in its interior portions.

Figure 8:
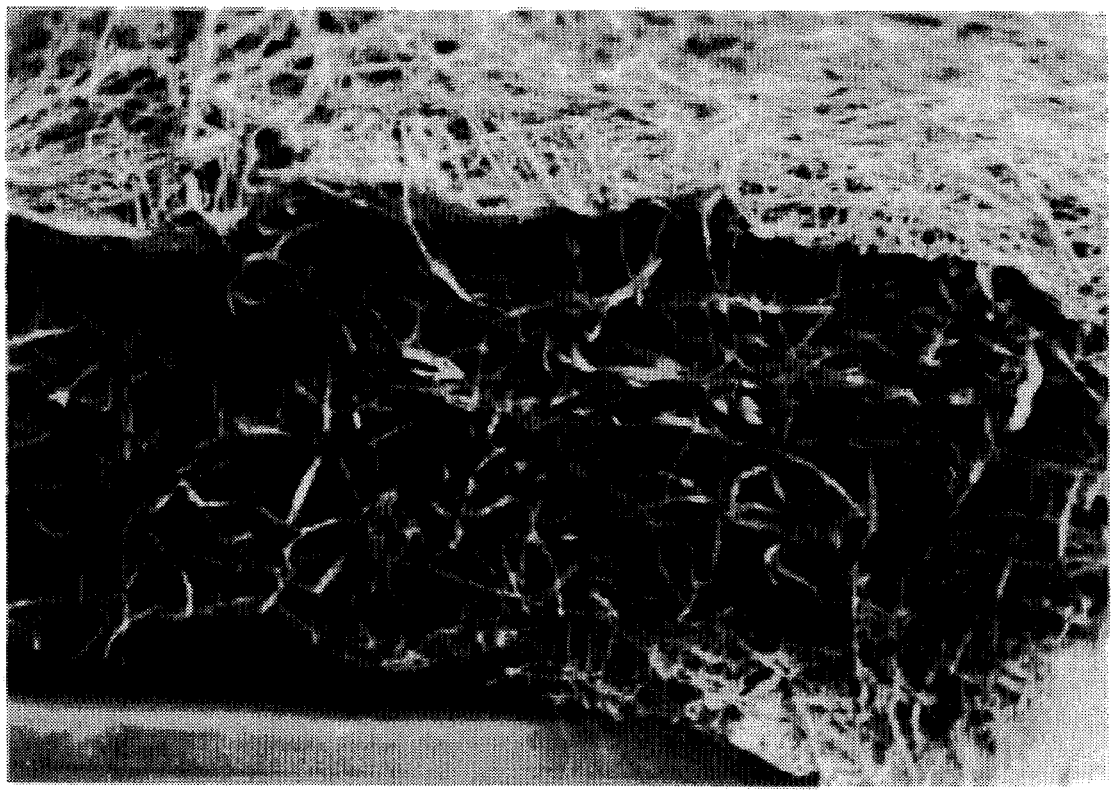
FIG. 8 is a photomicrograph of an exemplary layered fibrous nonwoven composite structure.
Figure 9:
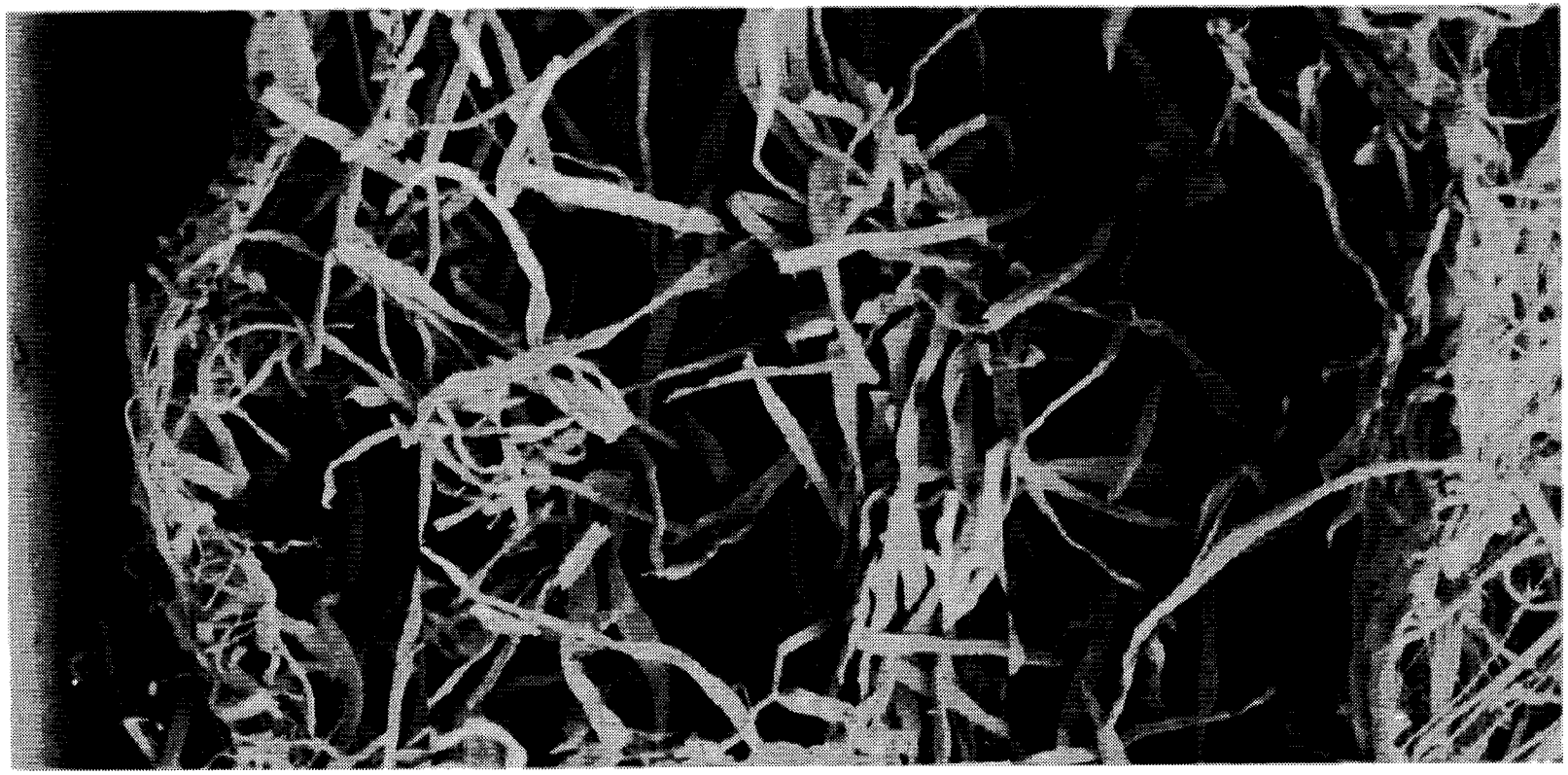
FIG. 9 is an enlarged photomicrograph of the exemplary layered fibrous nonwoven composite structure shown in FIG. 8.

FIG. 8 is a 20.7× (linear magnification) photomicrograph of an exemplary layered fibrous nonwoven composite structure. FIG. 9 is a 67.3× (linear magnification) photomicrograph of the exemplary layered fibrous nonwoven composite structure shown in FIG. 8. The composite structure shown in FIGS. 8 and 9 contains discrete layers of meltblown polypropylene fibers sandwiching a discrete layer of wood pulp. The photomicrographs show that meltblown fibers are substantially absent from the inner portion of the layered composite structure.

EXAMPLES

Tensile strength and elongation measurements of samples were made utilizing an Instron Model 1122 Universal Test Instrument in accordance with Method 5100 of Federal Test Method Standard No. 191A. Tensile strength refers to the maximum load or force (i.e., peak load) encountered while elongating the sample to break. Measurements of peak load were made in the machine and cross-machine directions for wet samples. The results are expressed in units of force (pounds$_f$) for samples that measured 1 inch wide by 6 inches long.

Trapezoidal tear strengths of samples were measured in accordance with ASTM Standard Test D 1117-14 except that the tearing load is calculated as an average of the first and the highest peak loads rather than an average of the lowest and highest peak loads.

Particles and fibers shed from sample fabrics were measured by a Climet Lint test in accordance with INDA Standard Test 160.0-83 except that the sample size is 6 inch by 6 inch instead of 7 inch by 8 inch.

Water absorption capacities of samples were measured in accordance with Federal Specification No. UU-T-595C on industrial and institutional towels and wiping papers. The absorptive capacity refers to the capacity of a material to absorb liquid over a period of time and is related to the total amount of liquid held by a material at its point of saturation. Absorptive capacity is determined by measuring the increase in the weight of a material sample resulting from the absorption of a liquid. Absorptive capacity may be expressed, in percent, as the weight of liquid absorbed divided by the weight of the sample by the following equation:

$$\text{Total Absorptive Capacity}=[(\text{saturated sample weight}-\text{sample weight})/\text{sample weight}]\times 100.$$

The "water rate" or "absorption rate refers to the rate at which a drop of water is absorbed by a flat, level sample of material. The water rate was determined in accordance with TAPPI Standard Method T432-SU-72 with the following changes: 1) three separate drops are timed on each sample; and 2) five samples are tested instead of ten.

Water wicking rates of samples were measured in accordance with TAPPI Method UM451. The wicking rate refers to the rate at which water is drawn in the vertical direction by a strip of an absorbent material.

The static and dynamic coefficient of friction (C.O.F.) of samples was measured in accordance with ASTM 1894.

The peel strength or Z-direction integrity of samples was measured using a peel strength test which conforms to ASTM Standard Test D-2724.13 and to Method 5951, Federal Test Method Standard No. 191A, with the following exceptions: 1) peel strength of a material is calculated as the average peak load of all the specimens tested; 2) specimen size is 2 inches×6 inches; and 3) Gauge length is set at 1 inch.

The cup crush test properties of samples were measured. The cup crush test evaluates fabric stiffness by measuring the peak load required for a 4.5 cm diameter hemispherically shaped foot to crush a 7.5 inch '7.5 inch piece of fabric shaped into an approximately 6.5 cm diameter by 6.5 cm tall inverted cup while the cup shaped fabric was surrounded by an approximately 6.5 cm diameter cylinder to maintain a uniform deformation of the cup shaped fabric. The foot and the cup were aligned to avoid contact between the cup walls and the foot which could affect the peak load. The peak load was measured while the foot was descending at a rate of about 0.25 inches per second (15 inches per minute) utilizing a Model FTD-G-500 load cell (500 gram range) available from the Schaevitz Company, Tennsauken, N.J.

The basis weights of samples were determined essentially in accordance with ASTM D-3776-9 with the following changes: 1) sample size was 4 inches×4 inches square; and 2) a total of 9 samples were weighed.

The rate of liquid migration was determined from the liquid distribution within a stack of moist wipes. Liquid migration was measured using a stack of 80 wet wipes produced by machine converting or by hand. Each wipe measured about 7.5 inches by 7.5 inches and had a Z-fold configuration. The wipes were impregnated with a solution containing about 97 percent, by weight water; about 1 percent, by weight, propylene glycol; and about 0.6 percent, by weight, PEG-75 lanolin. PEG-75 lanolin is available from Henkel Corporation, Cincinnati, Ohio. Once the wipes reached a stabilized liquid add-on of about 330 percent, based on the dry weight of each wipe, the wipes were placed in a wipe tub for storage. After an interval of about 30 days the wipes were removed and the entire stack was weighed. Each wipe was weighed separately and returned to its original position in the stack. The stack was placed in an oven and dried. After the wipes were dried, the entire stack and each individual wipe was weighed to obtain a dry weight. The moisture add-on of each wipe was determined by using the formula:

$$\text{Moisture add-on}=(\text{Wet weight}-\text{dry weight})/\text{dry weight}*100$$

The moisture add-on data was plotted on a graph with wipe stack position (1–80) on the x-axis and moisture add-on (expressed as a percent) on the y-axis. Data from the five wipes on the top (1–5) and bottom (76–80) were discarded due to over-drying in the oven. The relationship between moisture add-on and stack positions was assumed to be linear. A line was generated from the data points using linear regression. The slope of that line is defined as the rate of liquid migration. In order to maintain a relatively uniform distribution of liquid within a stack of wipes, a low rate of liquid migration (i.e., a low slope) is more desirable than a high rate of liquid migration (i.e., a high slope).

Abrasion resistance testing was conducted on a Stoll Quartermaster universal wear Tester Model No. CS-22C SC1 available from Custom Scientific Instrument Company, Cedar Knoll, N. J. Samples were subjected to abrasion cycles under a head weight of about 0.5 pounds. The abradant head was loaded with a ⅛ inch thick piece of high-density spring rubber (Catalog Number 8630K74) available from McMaster Carr, Elmhurst, Ill. New abradant was conditioned by running over two samples for 1000 cycles. Tests were conducted until the first completely loose fiber "pill" was formed on the specimen. That is, until the presence of a fiber "pill" that could be easily removed from the test surface with a pick. Testing was stopped approximately every thirty cycles to examine the test surface for fiber "pills." Abrasion resistance is reported as the number of cycles required until formation of a completely loose fiber "pill" and is an average value based on tests of 15 samples.

EXAMPLE 1

Fibrous nonwoven composite structures containing fiberized wood pulp and meltblown polypropylene fibers were produced in accordance with the general procedure described above and illustrated in FIGS. 1 and 2. The fiberized wood pulp was a mixture of about 80 percent, by weight, bleached softwood kraft pulp and about 20 percent, by weight, bleached hardwood kraft pulp available from the Weyerhaeuser Corporation under the trade designation Weyerhaeuser NF-405. The polypropylene was available from the Himont Chemical Company under the trade designation Himont PF-015. Meltblown fibers were formed by extruding the polypropylene into molten threads at a rate of about 90 lb/hour per die at an extrusion temperature of 500 degrees F. The molten threads were attenuated in an air stream having a flow rate of about 600–650 standard cubic feet per minute (scfm) and a temperature of 530 degrees F.

Roll pulp was fiberized in a conventional picker unit. Individual pulp fibers were suspended in an air stream having a pressure of about 2.6 pounds per square inch. The two air streams containing the entrained meltblown fibers impinged the air stream containing pulp fibers under specified conditions to cause varying degrees of integration of the streams. The merged streams were directed onto a forming wire and the integrated fibers were collected in the form of a composite material with the aid of an under-wire vacuum. The composite material was bonded by applying heat and pressure to a patterned bond roll and a smooth anvil roll. The patterned bond roll was operated at a pressure of about 49 pounds per linear inch to impart a bond pattern having a surface area of about 8.5 percent. Bonding took place while the bond roll was at a temperature of about 190 degrees Centigrade and the anvil roll was at a temperature of 170 degrees Centigrade.

The specific properties and structure of the composite material varied according to changes in the process variables. The process variables that were modified to produce the various materials of this example were (1) the distance between the two die tips (i.e., distance $\alpha$) and (2) angle of the die tips (i.e., die angle $\Theta$).

The material was targeted to have a pulp-to-polymer ratio of about 65 percent, by weight, pulp and about 35 percent, by weight polymer. The pulp/polymer ratio was set utilizing a mass balance. This mass balance was based on the amount of pulp and the amount of polymer introduced into the process. Assuming that all the pulp and polymer introduced into the process is converted into a composite material, the pulp/polymer ratio of the composite can be calculated. For example, the process described above contains two meltblowing dies. Each die processes polymer into meltblown at a steady rate of about 90 lbs/hour (for a total polymer rate of about 180 lbs/hr). Since the composite was intended to have a pulp/polymer ratio of 65/35 (i.e., about 65 percent, by weight, pulp and about 35 percent, by weight, polymer), the pulp feed into the process was calculated to be about 180 * (65/35). Thus, the pulp feed into the process was set at about 334 lbs/hour.

In order to check the process settings, components of the composite material were formed separately and then weighed. In this situation, a composite material having a pulp/polymer ratio of 65/35 and a basis weight of 72 gsm was desired. The process was first operated without adding pulp to the fiberizer so that a meltblown fiber web was formed at the specified polymer input. The meltblown web had a basis weight of about 39 gsm. Pulp was added to the process at the calculated throughput so that a composite of meltblown fibers and pulp was produced. The composite had a total basis weight of about 72 gsm which corresponds to a pulp/polymer ratio of about 65/35. The pulp/polymer ratio can vary slightly from the target value during normal operation of the process but should generally fall within about 5 to 10 percent of the target value. This can be seen from the pulp/polymer ratios reported in Table 1 which were determine using analytical image analysis.

Description of the process conditions and the materials produced in accordance with this example are given in Tables 1 and 2.

TABLE 1

PROCESS CONDITIONS

| Sample | Pulp/ Poly Ratio | Die Tip Dist (α) (inch) | Die Tip Angle (θ) (degrees) | Basis Weight ($g/m^2$) |
|---|---|---|---|---|
| Homogeneous | 58/42 | 6.5 | 50 | 72 |
| Gradient | 60/40 | 6.5 | 55 | 72 |
| Layered | 60/40 | 16.5 | 75 | 72 |

| Sample | Tip to Wire Dist (β) (inch) | Tip to Impingement Zone Dist (X) (inch) | Impingmt Zone to Forming Surf Dist (Y) (inch) |
|---|---|---|---|
| Homogeneous | 11 | 2.5 | 7.1 |
| Gradient | 11 | 2.8 | 6.4 |
| Layered | 11 | 13.8 | 0 |

TABLE 2

PHYSICAL PROPERTIES

| Sample | Peel MD-Wet (lb) | Peel CD-Wet (lb) | Trap Tear Md-Wet (lb) | Trap Tear CD-Wet (lb) | Strip Tensile MD-Wet (lb) | Strip Tensile CD-Wet (lb) |
|---|---|---|---|---|---|---|
| Homogeneous | 0.15 | 0.18 | 0.40 | 0.15 | 1.98 | 0.47 |
| Gradient | 0.16 | 0.15 | 0.80 | 0.31 | 2.21 | 0.48 |
| Layered | 0.02 | 0.02 | 0.57 | 0.18 | 0.74 | 0.37 |

| Sample | Cup Crush Wet (g/mm) | C.O.F. Static (g) | C.O.F. Dynamic (g) | Climet Lint 10μ/0.5μ | Frazier Porosity ($ft^3/min/ft^2$) |
|---|---|---|---|---|---|
| Homogeneous | 2008 | 0.29 | 0.23 | 55/230 | 71.56 |
| Gradient | 1849 | 0.28 | 0.22 | 36/157 | 68.84 |
| Layered | 1784 | 0.25 | 0.20 | 103/894 | 181.52 |

| Sample | Peel (MD) Strength (lb) | Trap (MD) Tear (lb) | Abrasion Resistance X | Abrasion Resistance σ |
|---|---|---|---|---|
| Homogeneous | 0.15 | 0.40 | 161 | 84 |
| Gradient | 0.16 | 0.80 | 328 | 173 |
| Layered | 0.02 | 0.57 | 144 | 39 |

| Sample | Absorption Capacity ($g/m^2$) | Absorption Rate (sec) | Wicking CD/MD* (cm/60 sec) |
|---|---|---|---|
| Homogeneous | 668 | 0.73 | 3.5/4.4 |
| Gradient | 687 | 0.74 | 3.7/4.2 |
| Layered | 691 | 0.61 | 3.4/3.0 |

*CD = cross-machine direction, MD = machine direction

It can be seen from Tables 1 and 2 that the fibrous nonwoven composite structures and their associated physical properties can be modified by changing the die angle and the distance between the meltblowing die tips. When the distance between the meltblowing die tips was 6.5 inches, a die angle of 55 degrees produced a "gradient" material. That is, a material was produced which was rich in polymer fibers adjacent its outer surfaces and had a pulp-rich interior region. This gradient material is shown in the photomicrographs of FIGS. 4 and 5. As can be seen, there is no sharply distinct layer of pulp offset by a layer completely composed of meltblown fibers. Instead, there is a gradual changing blend of components which can be seen as a regular, step-by-step transition of fiber concentration from the pulp-rich interior to the polymer fiber-rich exterior regions. As noted above, it is believed that this gradual changing blend of components provides desirable integrity and strength to the structure. For example, the gradient material has trapezoidal tear strengths and peel strengths which matched the desirable levels obtained by the homogenous structure. Although the each of the sample materials were bonded after formation, the gradient materials can be used without bonding or other post-treatments because of the strength and integrity of the structure.

The gradient structure also provides for successful integration of high levels of small secondary fibers (e.g., pulp) and/or particulates while providing enhanced abrasion resistance when compared to homogenous structures and layered structures. The gradient structure also provides desirable levels of particle/fiber capture or particle/fiber retention. This is evident in a comparison of the Climet Lint test results. Although the inventors should not be held to a particular theory of operation, it is believed that the superior results of the gradient material can be attributed to: (1) intimate mixing, entangling, and to some extent, point bonding of tacky, partially molten meltblown fibers to the secondary material, and (2) the enclosure effect provided by high concentration of meltblown fibers adjacent the exterior surfaces of the structure. Importantly, while the high concentrations of meltblown fibers adjacent the exterior surfaces reduces fiber/particle loss, it does not appear to have an impact on the liquid handling abilities of the material as demonstrated by the measurements of absorption capacity, absorption rate and wicking rate.

When the die angle was changed to about 50 degrees, a homogenous material was produced. That is, a material having a generally uniform distribution of meltblown fibers and pulp throughout the fibrous nonwoven structure. This homogenous material is shown in the photomicrographs of FIGS. 6 and 7.

When the die angle was changed to about 75 degrees, a layered fibrous nonwoven structure was produced. That is, a material which has a top and bottom layer of meltblown fibers sandwiching a layer of pulp which is substantially free of meltblown fibers. This layered fibrous nonwoven structure is shown in the photomicrographs of FIGS. 8 and 9.

Although this layered fibrous nonwoven composite structure has virtually all of its polymeric fibers at its exterior surfaces and virtually all of its pulp in its interior portion, the layered structure had poor strength characteristics, abrasion resistance and pulp capture; despite the pattern bonding of the structure. It is believed that sharply defined zones of concentration present in layered structure are unable to provide the level of integration between the components that is achieved by the gradient structure.

ANALYTICAL IMAGE ANALYSIS

Concentrations of meltblown polymer fibers and pulp fibers adjacent the exterior surfaces and in the interior portions of samples were determined by analytical image analysis. In this analytical technique, scanning electron photomicrographs at 100× (linear) magnification were made for each side of three ½ inch square samples. The scanning electron photomicrographs had a viewing depth of approximately 150 μm. Each photomicrograph had a field of about 1000 μm×700 μm and was overlayed by a 5×5 grid, sectioning each photomicrograph into 25 sections. Each field was separated by 1000 μm. The amount of pulp fibers and the length of the pulp fibers were visually recorded for each field in the photomicrograph.

Density of pulp fibers was assumed to be about 1.2 grams/cm$^3$. Density of polypropylene was assumed to be about 0.91 grams/cm$^3$. Average pulp fiber diameter was assumed to be about 50 μm for areal calculations. Volume and mass calculations assumed each pulp fiber had a cross-section which measured about 10 μm×70 μm.

The thickness of each sample was measured from razor cut cross-sections viewed on edge using incident light. Acid was used to extract the cellulose (e.g. wood pulp) from the sample. A pulp/polymer ratio of the entire sample (i.e, a bulk pulp/polymer ratio) was determined by comparing the initial sample weight (containing pulp and polymer) to the dry weight of the acid treated sample (with the pulp removed).

Pulp ratios for a sample surface were based on the stereological equivalence of percent area and percent volume. This assumption permits mass ratios to be calculated for a sample surface using the area and density. A pulp/polymer ratio for the inner (non-surface layer) portion of the sample was calculated using the following formula:

$$R_c=(H_o*R_o-(H_s*(R_{s1}=R_{s2}))/H_c$$

where:

$R_c$=pulp/polymer ratio for the inner (non-surface layer or central) portion.

$H_c$=height of the inner (non-surface layer or central) portion.

$R_o$=pulp/polymer ratio for the overall sample (determined by acid-extraction).

$H_o$=height of the overall sample.

$R_{s1}$=pulp/polymer ratio for the first surface layer (determined by analytical image analysis).

$R_{s2}$=pulp/polymer ratio for the second surface layer (determined by analytical image analysis).

$H_s$=height of the combined surface layers (combined viewing depth of the scanning electron microphotographs), Samples described in Tables 1 and 2 were analyzed as described above. The pulp/polymer ratios for the samples are reported in Table 3.

TABLE 3

| | PULP/POLYMER RATIOS | | | |
|---|---|---|---|---|
| Sample | Bulk | Surface A | Surface B | Inner Portion |
| Homogeneous | 58/42 | 54/46 | 56/45 | 59/41 |
| Gradient | 60/40 | 24/76 | 30/70 | 64/36 |
| Layered | 60/40 | 10/90 | 10/90 | 64/36 |

The gradient structure which serves as one example of the present invention had an overall (bulk) pulp/polymer ratio of 60/40 and an average concentration of polymer fibers in its outer surface regions (i.e., within the field of view of the scanning electron photomicrograph) of about 73 percent. By calculation, The gradient structure had a concentration of polymer fibers in its interior portion of about 35 percent.

EXAMPLE 2

Fibrous nonwoven composite structures containing fiberized wood pulp and meltblown polypropylene fibers were produced in accordance with the general procedure described in Example 1 and illustrated in FIGS. 1 and 2. The fiberized wood pulp was a mixture of about 80 percent, by weight, bleached softwood kraft pulp and about 20 percent, by weight, bleached hardwood kraft pulp available from the Weyerhaeuser Corporation under the trade designation Weyerhaeuser NF-405. The polypropylene was available from the Himont Chemical Company under the trade designation Himont PF-015. Meltblown fibers were formed by extruding the polypropylene into molten threads at a rate of about 90 lb/hour per die at an extrusion temperature of 520 degrees F. The molten threads were attenuated in a primary air stream having a flow rate of 800 scfm and a temperature of 530 degrees F.

Roll pulp was fiberized in a conventional picker unit. Individual pulp fibers were suspended in a secondary air stream having a pressure of about 40 inches of water. The two primary air streams containing the entrained meltblown fibers impinged the secondary air stream under specified conditions to cause varying degrees of integration of the streams. The merged streams continued onto a forming wire and the fibers were collected in the form of a composite material which had a greater concentration of meltblown fibers at about its surfaces and a lower concentration of meltblown fibers (i.e., more pulp) in its interior portions. The specific properties and structure of the composite material varied according to changes in the process variables and material variables. The process variables that were modified to produce the various materials of this example were (1) the distance between the two die tips (i.e., the distance α) and (2) angle of the die tips (i.e., die angle Θ). The material variable that was changed was the pulp-to-polymer ratio. The pulp/polymer ratio was determined and confirmed as described in Example 1.

The various fibrous nonwoven composite structures produced are listed in Table 4. Those structures were tested to determine how the mean flow pore size of the nonwoven composite was affected by process changes. The structures were also tested to determine how well they were able to maintain a uniform distribution of liquid within a vertical stack composed of individual sheets of the composite structure. Such a configuration is common when the fibrous nonwoven composite structures are packaged for use as moist wipes. Such packages may be stored almost indefinitely and must maintain a substantially uniform distribution of moisture within the stack stored. That is, the top of the stack should not dry out and the liquid should not collect in the bottom of the stack. The results of this testing is reported as the Rate of Liquid Migration in Table 4.

TABLE 4

| No. | Pulp/ Polymer | Die Tip Dist (α) | Die Tip Angle (θ) | % Pores Below 35μ | Rate of Liquid Migration |
|---|---|---|---|---|---|
| 1 | 55/45 | 5" | 35° | 57% | 2.08 |
| 2 | 55/45 | 5" | 55° | 65% | 1.90 |
| 3 | 65/35 | 5" | 35° | 61% | 1.41 |
| 4 | 65/35 | 9" | 55° | 67% | 1.24 |
| 5 | 55/45 | 9" | 55° | 69% | 1.18 |
| 6 | 65/35 | 9" | 55° | 68% | 1.49 |
| 7 | 65/35 | 5" | 35° | 63% | 1.88 |
| 8 | 55/45 | 9" | 35° | 80% | 1.04 |
| 9 | 60/40 | 7" | 45° | 72% | 1.48 |

As described above, the fibrous nonwoven composite structure and its associated properties can be modified to meet required product attributes. In a tub of wet wipes, it is important to maintain an even distribution of moisture through out the stack. Without an even distribution of moisture, the top portion of the stack will be dry and the bottom portion of the stack will be saturated.

It has been found that the distribution of moisture in a tub of wipes can be improved when portions of the structure near the exterior surfaces have a greater percentage of polymer microfibers. This increases the relative amount of very small pores, that is, pores having a mean flow pore size below 35 microns. Generally speaking, this can be accomplished in the process described above by setting the distance between the die tips (i.e., distance α) greater than 9 inches. A relatively large distance between the die tips corresponds to a greater deceleration of the air stream carrying the entrained and attenuated meltblown fibers. This reduces the amount of mixing which takes place between the pulp and the meltblown fibers in the impingement zone. Additionally, a greater distance between the meltblowing die tips lowers the impingement zone (location where the air streams meet) to a position much closer to the forming wire. This shortened distance limits the time available for fiber mixing. The two process changes produce a graduated distribution of pulp with the meltblown fiber matrix. The portions of the structure near the surfaces have a greater percentage of polymer microfibers, which increases the relative amount of small pores.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. An abrasion resistant fibrous nonwoven composite structure comprising:

a matrix of meltblown fibers having a first exterior surface, a second exterior surface, and an interior portion; and at least one other fibrous material integrated into the meltblown fiber matrix so that the concentration of meltblown fibers adjacent each exterior surface of the nonwoven structure is at least about 60 percent, by weight, and the concentration of meltblown fibers in the interior portion is less than about 40 percent, by weight.

2. The fibrous nonwoven composite structure of claim 1 wherein the composite has an abrasion resistance that is at least about 30 percent greater than that of a homogenous mixture of the same components.

3. The fibrous nonwoven composite structure of claim 2 wherein the composite has an abrasion resistance that is from about 50 to about 150 percent greater than that of a homogenous mixture of the same components.

4. The fibrous nonwoven composite structure of claim 1 wherein the matrix of meltblown fibers is a matrix of meltblown fibers selected from the group consisting of polyolefin fibers, polyamide fibers, polyester fibers, polyurethane fibers, polyvinyl alcohol fibers, polycaprolactone fibers and mixtures of the same.

5. The fibrous nonwoven composite structure of claim 4 wherein the polyolefin fibers are formed from a polyolefin selected from the group consisting of polyethylene, polypropylene, polybutylene, copolymers of ethylene, copolymers of propylene, copolymers of butylene and mixtures of the same.

6. The fibrous nonwoven composite structure of claim 1 wherein the other material is selected from the group consisting of polyester fibers, polyamide fibers, polyolefin fibers, cellulosic derived fibers, multi-component fibers, natural fibers, absorbent fibers, or blends of two or more of said fibers.

7. The fibrous nonwoven composite structure of claim 1 wherein the concentration of meltblown fibers adjacent each exterior surface is from about 70 to about 90 percent, by weight, and the concentration of meltblown fibers in the interior portion is less than about 35 percent, by weight.

8. A nonwoven composite material comprising at least two layers of the abrasion resistant fibrous nonwoven composite structure according to claim 1.

9. An abrasion resistant, high pulp content fibrous nonwoven composite structure comprising:

less than about 35 percent, based upon the total weight percent of said structure, meltblown fibers forming a matrix having a first exterior surface, a second exterior surface, and an interior portion; and more than about 65 percent, based upon the total weight percent of said structure, pulp fibers integrated into the meltblown fiber matrix so that the concentration of meltblown fibers adjacent each exterior surface of the nonwoven structure is at least about 60 percent, by weight, and the concentration of meltblown fibers in the interior portion is less than about 40 percent, by weight.

10. The fibrous nonwoven composite structure of claim 9 wherein the composite has a lint loss of less than about 50 particles of 10 micron size per 0.01 $ft^3$ of air and less than about 200 particles of 0.5 micron size per 0.01 $ft^3$ of air as determined in accordance with dry Climet Lint test methods.

11. The fibrous nonwoven composite structure of claim 9 wherein the composite has an abrasion resistance that is at least about 30 percent greater than that of a homogenous mixture of the same components.

12. The fibrous nonwoven composite structure of claim 11 wherein the composite has an abrasion resistance that is from about 50 to about 150 percent greater than that of a homogenous mixture of the same components.

13. The fibrous nonwoven composite structure of claim 9 wherein the matrix of meltblown fibers is a matrix of meltblown fibers selected from the group consisting of polyolefin fibers, polyamide fibers, polyester fibers, polyurethane fibers, polyvinyl alcohol fibers, polycaprolactone fibers and mixtures of the same.

14. The fibrous nonwoven composite structure of claim 13 wherein the polyolefin is selected from the group consisting of polyethylene, polypropylene, polybutylene, copolymers of ethylene, copolymers of propylene, copolymers of butylene and mixtures of the same.

15. The fibrous nonwoven composite structure of claim 9 wherein the overall pulp content of the structure ranges from about 65 to about 95 percent, based on the total weight of the structure.

16. The fibrous nonwoven composite structure of claim 9 wherein the concentration of meltblown fibers adjacent each exterior surface is from about 70 to about 90 percent, by weight, and the concentration of meltblown fibers is the interior portion is less than about 20 percent, by weight.

17. A nonwoven composite material comprising at least two layers of the abrasion resistant, high pulp content abrasion resistant fibrous nonwoven composite structure according to claim 9.

18. A process of making an abrasion resistant fibrous nonwoven composite structure comprising:

providing a first and second stream of meltblown thermoplastic polymer fibers in intersecting relationship to form an impingement zone, introducing a stream of secondary material between the first and second streams of meltblown thermoplastic polymer fibers and into the impingement zone to form a composite stream; and collecting the composite stream on a forming surface as a matrix of meltblown thermoplastic polymer fibers having the secondary material integrated into the meltblown fiber matrix so that the concentration of meltblown fibers adjacent each exterior surface of the nonwoven structure is at least about 60 percent, by weight, and the concentration of meltblown fibers in the interior portion is less than about 40 percent, by weight.

* * * * *